US008025150B2

(12) United States Patent
Okuma et al.

(10) Patent No.: US 8,025,150 B2
(45) Date of Patent: Sep. 27, 2011

(54) CUSHIONING MEMBER

(75) Inventors: Hiroaki Okuma, Ebina (JP); Toshikazu Tsumita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/796,154

(22) Filed: Jun. 8, 2010

(65) Prior Publication Data

US 2011/0073520 A1 Mar. 31, 2011

(30) Foreign Application Priority Data

Sep. 25, 2009 (JP) ..... 2009-220802

(51) Int. Cl.
*B65D 85/30* (2006.01)

(52) U.S. Cl. ..... 206/590; 206/523; 206/586; 206/576; 206/320

(58) Field of Classification Search ..... 206/592, 206/523, 524, 586, 413–416, 446, 303, 521.2, 206/590

See application file for complete search history.

(56) References Cited

U.S. PATENT DOCUMENTS

| | | | | |
|---|---|---|---|---|
| 3,596,822 | A * | 8/1971 | Holley | 220/4.24 |
| 5,127,526 | A * | 7/1992 | Vigue | 206/587 |
| 5,405,012 | A * | 4/1995 | Shindler et al. | 206/569 |
| 5,701,999 | A * | 12/1997 | Phillips et al. | 206/320 |
| 5,779,045 | A * | 7/1998 | Yu | 206/320 |

FOREIGN PATENT DOCUMENTS

JP A-2006-206138 8/2006

* cited by examiner

*Primary Examiner* — Mickey Yu
*Assistant Examiner* — Chun Cheung
(74) *Attorney, Agent, or Firm* — Oliff & Berridge, PLC

(57) ABSTRACT

When a cushioning member is fitted to a tubular part in a first facing direction, an inner circumferential surface of the tubular part contacts a part of a second protruding portion, a first portion of a first protruding portion contacts a first contact region, a second portion of a third protruding portion contacts a second contact region, a third portion of the third protruding portion contacts a third contact region, and a distance between the first contact region and the second contact region is smaller than a distance between the first contact region and the third contact region, and a length of the second contact region from a base portion in a direction of protrusion is greater than a length of the third contact region from the base portion in a direction of protrusion.

11 Claims, 5 Drawing Sheets

CUSHIONING MEMBER

CROSS-REFERENCE TO RELATED APPLICATIONS

This application is based on and claims priority under 35 USC 119 from Japanese Patent Application No. 2009-220802 filed on Sep. 25, 2009.

BACKGROUND

1. Technical Field

The present invention relates to a cushioning member.

2. Related Art

To prevent damage resulting from an external shock imparted to a packed product, it is common to provide such a product with protection in the form of a cushioning member, which member typically consists of resin or polystyrene foam.

SUMMARY

According to an aspect of the invention, there is provided a cushioning member including: a base portion; a first protruding portion that protrudes from the base portion, and has a first portion protruding from a sidewall of the first protruding portion; a second protruding portion that protrudes from the base portion, and has a part protruding from a sidewall of the second protruding portion; and a third protruding portion that protrudes from the base portion, and has a second portion and a third portion protruding from a sidewall of the third protruding portion; and wherein: the first protruding portion is located between the second protruding portion and the third protruding portion; when the cushioning member is fitted to a tubular part in a first facing direction, an inner circumferential surface of the tubular part contacts the part of the second protruding portion, the first portion contacts a first contact region, the second portion contacts a second contact region, and the third portion contacts a third contact region, the first contact region being located between the second contact region and the third contact region as viewed in a direction normal to the first contact region, and a distance between the first contact region and the second contact region is smaller than a distance between the first contact region and the third contact region, and a length of the second contact region from the base portion in a direction of protrusion is greater than a length of the third contact region from the base portion in a direction of protrusion.

BRIEF DESCRIPTION OF THE DRAWINGS

Exemplary embodiment of the present invention will be described in detail based on the following figures, wherein.

DETAILED DESCRIPTION

Exemplary Embodiment

Figure 1:
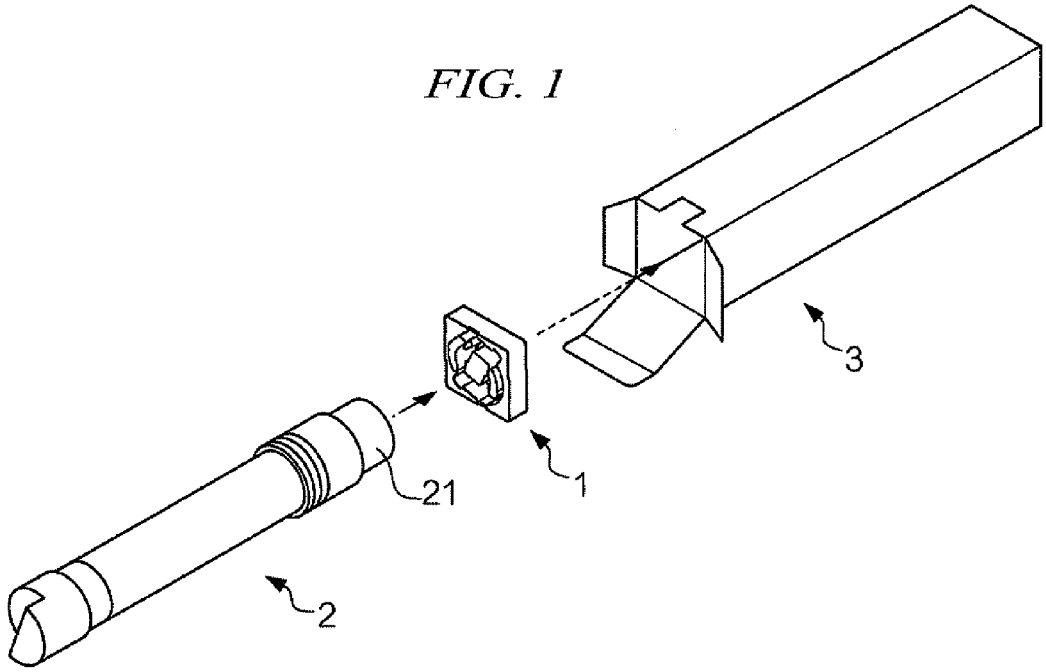
FIG. 1 is a functional overview of a cushioning member according to an exemplary embodiment of the present invention.

FIG. 1 is a functional overview of a cushioning member according to an exemplary embodiment of the present invention. As shown in FIG. 1, cushioning member 1 according to the exemplary embodiment is fitted to a product of powder cartridge 2 to fix a position of powder cartridge 2 inside packing box 3. Cushioning member 1 is positioned between powder cartridge 2 and packing box 3 within the interior of packing box 3. Cushioning member 1 absorbs shock imparted from the outside of the packing box, and protects powder cartridge 2. Cushioning member 1 is, for example, formed of resin, but any suitable shock-absorbing material can be used for cushioning member 1. Powder cartridge 2 is a columnar member containing inside a developer. Powder cartridge 2 is a powder container containing inside a powder, such as a toner or a resin powder. Preferably, the powder is a toner. Powder cartridge 2 has attachment portion 21 at one end. Cushioning member 1 is fitted to attachment portion 21. Attachment portion 21 is formed as a tubular part. Inside attachment portion 21, a memory (not shown) is provided. When powder cartridge 2 is attached to a device, the device can write or read data in or from the memory. In such a case, the memory can store information showing a remaining amount of developer in powder cartridge 2. Powder cartridge 2 can be attached to or detached from an electrophotographic image-forming apparatus (not shown). When powder cartridge 2 is attached to the image-forming apparatus and image-forming processing is performed, powder cartridge 2 discharges developer to a mechanism for forming an image. When the developer contained in powder cartridge 2 is consumed and powder cartridge 2 becomes empty, a user detaches powder cartridge 2 from the image-forming apparatus, and replaces powder cartridge 2 with a new one. At this time, the user extracts new powder cartridge 2 with cushioning member 1 from packing box 3, and detaches cushioning member 1 from new powder cartridge 2. Then, the user attaches new powder cartridge 2 to the image-forming apparatus. The user also attaches cushioning member 1 to used powder cartridge 2, which is detached from the image-forming apparatus, and stores used powder cartridge 2 in packing box 3, as indicated by an arrow in FIG. 1.

Figure 2:
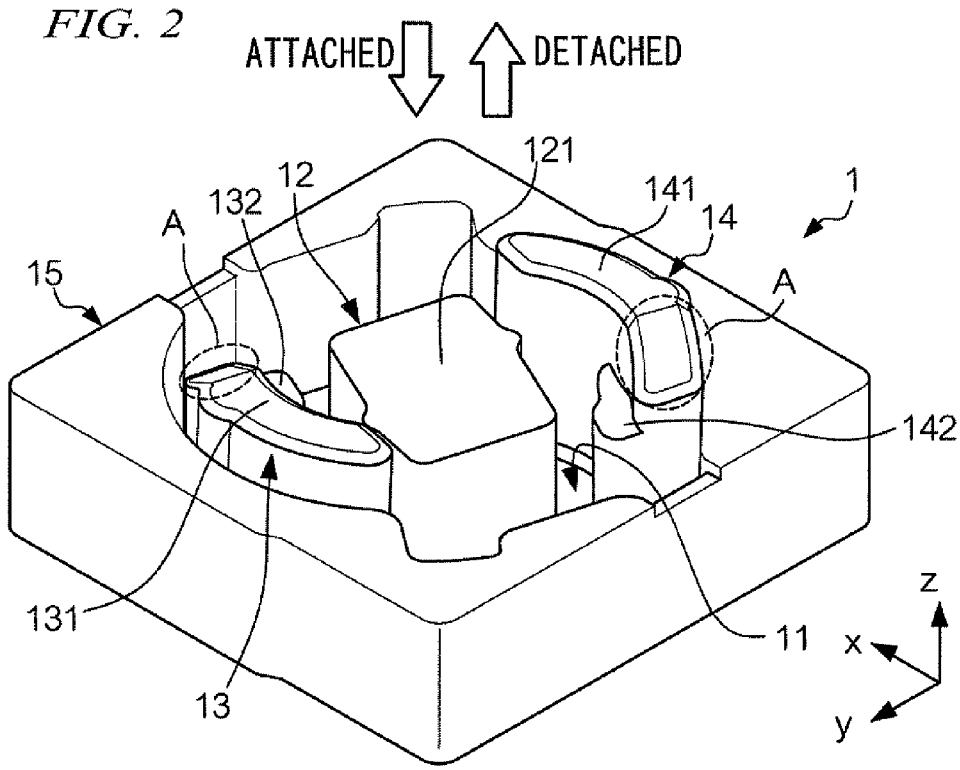
FIG. 2 is a perspective view of an exterior of the cushioning member.
Figure 3:
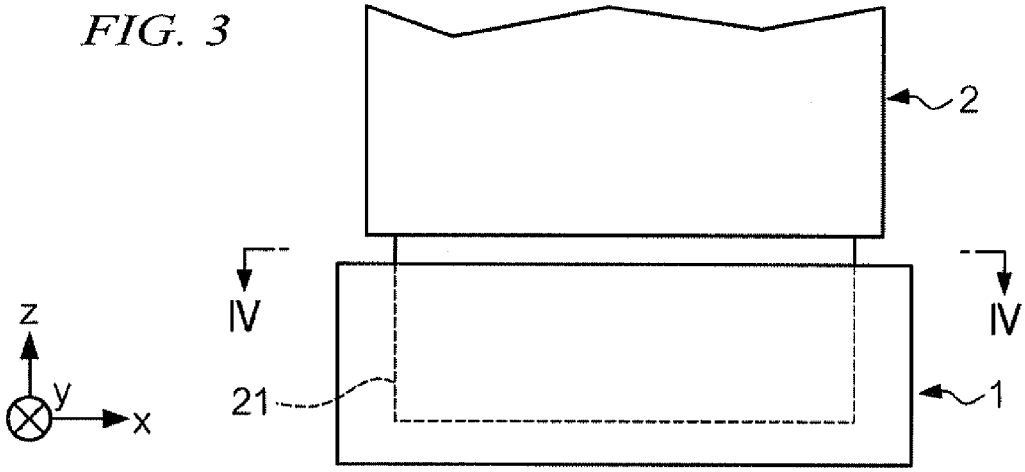
FIG. 3 is an external view of the cushioning member fitted to a powder cartridge.
Figure 4:
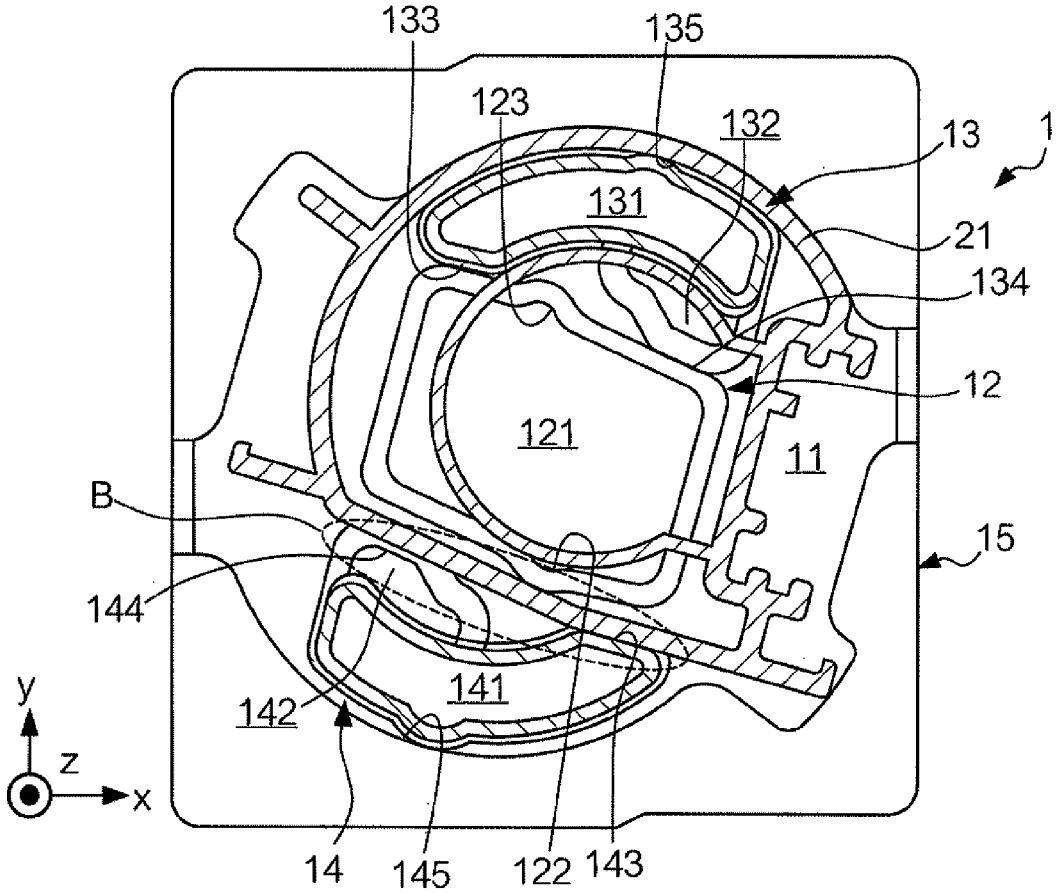
FIG. 4 is a cross-sectional view of the cushioning member and an attachment portion taken along section line IV-IV of FIG. 3.

Next, description is given for a structure of cushioning member 1. FIG. 2 is a perspective view of an exterior of cushioning member 1. FIG. 3 shows an exterior surrounding cushioning member 1 fitted to powder cartridge 2. FIG. 4 is a cross-sectional view of cushioning member 1 and attachment portion 21 taken along section line IV-IV of FIG. 3. As shown in FIGS. 2 to 4, cushioning member 1 includes a bottom having an approximate rectangle shape. Here, an x-axis is defined in a direction along one side of the bottom of cushioning member 1; a y-axis is defined as perpendicular to the x-axis and in a direction along another side of cushioning member 1; and a z-axis is defined as perpendicular to each of the x-axis and y-axis and in a direction indicated by an arrow in FIG. 2, in which powder cartridge 2 is attached or detached. In the following description, a structure of cushioning member 1 is described with reference to these axes.

Cushioning member 1 has base portion 11, first protruding portion 12, second protruding portion 13, third protruding portion 14, and outer edge portion 15. Base portion 11 extends to form a planar shape along an x-y planar direction. First protruding portion 12 protrudes from approximately the center of base portion 11. First protruding portion 12 has a protruding end 121 fitted on its top side. When cushioning member 1 is fitted to powder cartridge 2, protruding end 121 comes into contact with the memory included in powder cartridge 2. First protruding portion 12 also has convex portions 122 and 123 each protruding outwards from a sidewall of first protruding portion 12. Convex portion 122 is provided on a sidewall facing third protruding portion 14; while convex portion 123 is provided on a sidewall facing second protruding portion 13.

Second protruding portion 13 and third protruding portion 14 each protrude from base portion 11. First protruding portion 12 is located between second protruding portion 13 and third protruding portion 14. There are gaps between first protruding portion 12 and second protruding portion 13, and also between second protruding portion 13 and third protruding portion 14, to accommodate insertion of attachment portion 21 of powder cartridge 2. Second protruding portion 13 has protruding ends 131 and 132. Protruding end 131 of second protruding portion 13 is higher in the z-axial direction than protruding end 121 and protruding end 132. Protruding end 132 is lower in the z-axial direction than protruding end 131 due to a restriction imposed by a shape of powder cartridge 2, however protruding end 131 is not subject to such a height limitation, and as a result of which it is possible to increase advantageously a height of protruding end 131 of second protruding portion 13. The reason for increasing the height will be described later. Protruding ends 131 and 132 are in contact with specific portions of powder cartridge 2, and protect those portions with which they are in contact. Second protruding portion 13 has convex portions 133, 134, and 135 each extending outward from a sidewall of second protruding portion 13. Convex portions 133 and 134 are provided on a sidewall facing first protruding portion 12, and extend across convex portion 123 of first protruding portion 12. Convex portion 135 is provided on a sidewall facing outer edge portion 15 in opposing relation to first protruding portion 12.

Third protruding portion 14 has the same dimensions and shape as second protruding portion 13. Third protruding portion 14 is positioned in opposing relation to second protruding portion 13 across first protruding portion 12. Third protruding portion 14 has protruding ends 141 and 142. Protruding end 141 is higher in the z-axial direction than protruding end 121 and protruding end 142. Third protruding portion 14 also has convex portions 143, 144, and 145, each extending outward from a sidewall of third protruding portion 14. Convex portions 143 and 144 are provided on a sidewall facing first protruding portion 12. Convex portions 143 and 144 are located on either side of convex portion 122, as viewed in a direction normal to convex portion 122 of first protruding portion 12. Convex portion 145 is provided on a sidewall facing outer edge portion 15 in opposing relation to first protruding portion 12.

Outer edge portion 15 protrudes from base portion 11 along the outer edge of cushioning member 1. Outer edge portion 15 is provided to protect the outer circumferential surface of attachment portion 21 against external shock when cushioning member 1 is fitted to powder cartridge 2.

It is to be noted that a direction of protrusion of each of first protruding portion 12, second protruding portion 13, and third protruding portion 14 is the z-axial direction; and a direction perpendicular to the direction of protrusion is the x-y planar direction.

As shown in FIG. 4, when cushioning member 1 having the structure described above is fitted to powder cartridge 2, first protruding portion 12 contacts the inner circumferential surface of attachment portion 21 of powder cartridge 2 with convex portion 122 serving as the first portion. Powder cartridge 2 and a sidewall of first protruding portion 12 contact with each other at this one part. Second protruding portion 13 contacts the inner circumferential surface of attachment portion 21 of powder cartridge 2 with convex portion 135. Powder cartridge 2 and a sidewall of second protruding portion 13 are in contact with each other at least at this one part. Third protruding portion 14 contacts the outer circumferential surface of attachment portion 21 of powder cartridge 2 with convex portion 143 serving as the second portion, and convex portion 144 serving as the third portion. Powder cartridge 2 and a sidewall of third protruding portion 14 contact each other at these two parts. In FIG. 4, the direction in which powder cartridge 2 faces is an example of a first facing direction.

Figure 5:
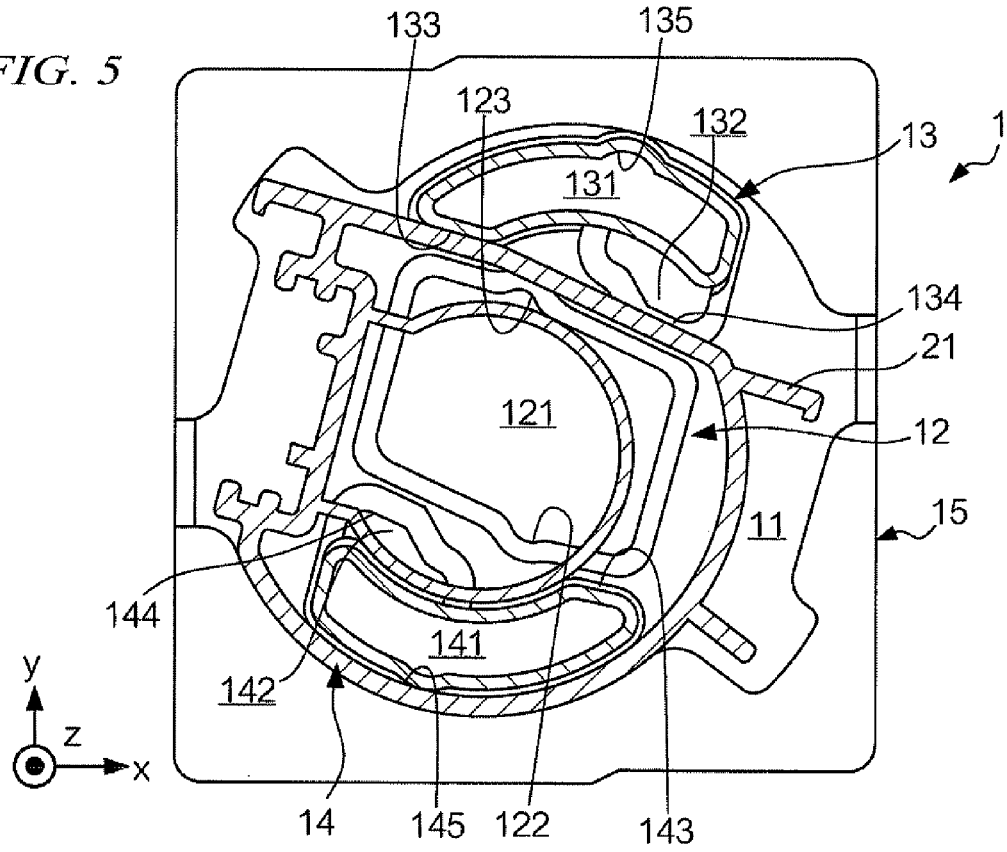
FIG. 5 is a cross-sectional view of the cushioning member fitted to the attachment portion rotated around z-axis by 180 degrees from an aspect shown in FIG. 4.

Cushioning member 1 is formed such that it can be fitted to attachment position 21 of Powder cartridge 2 where powder cartridge 2 is rotated around the z-axis by 180 degrees from a position shown in FIG. 4. FIG. 5 is a cross-sectional view of cushioning member 1 fitted to powder cartridge 2 in this facing direction. FIG. 5 shows a positional relationship between cushioning material 1 and attachment portion 21. In FIG. 5 the direction in which powder cartridge 2 faces is an example of a second facing direction.

The inner circumferential surface of attachment portion 21 of powder cartridge 2 contacts convex portion 145 of third protruding portion 14, and the inner circumferential surface also contacts convex portion 123 of first protruding portion 12 serving as the fourth portion. The outer circumferential surface of attachment portion 21 of powder cartridge 2 contacts each of convex portion 133 serving as the fifth portion, and convex portion 134 serving as the sixth portion. Convex portions 133 and 134 are located on either side of convex portion 123, as viewed in a direction normal to convex portion 123 of first protruding portion 12. Thus, cushioning member 1 is configured such that it can be fitted to powder cartridge 2 in either of two directions. As a result, a user can readily attach cushioning member 1 to powder cartridge 2, regardless of a direction in which powder cartridge 2 is facing.

Figure 6:
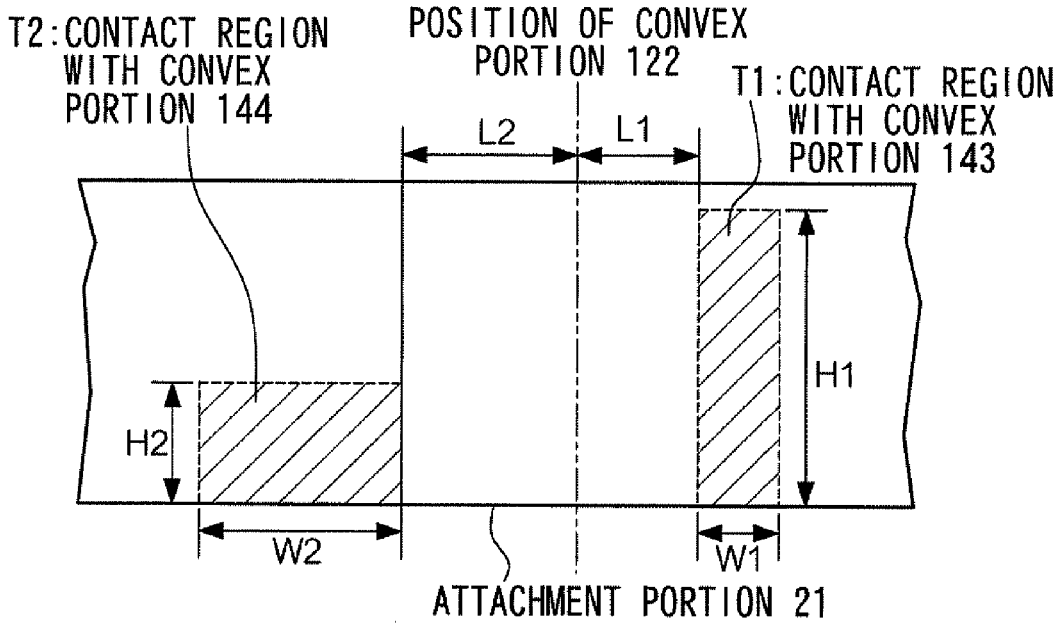
FIG. 6 shows the third protruding portion and the attachment portion where the cushioning member is fitted to the powder cartridge, according to the aspect shown in FIG. 4.

FIG. 6 shows contact regions of third protruding portion 14 and attachment portion 21 where cushioning member 1 is fitted to powder cartridge 2, according to the aspect shown in FIG. 4. FIG. 6 is a schematic view of attachment portion 21 of B part shown in FIG. 4, and viewed in a direction normal to convex portion 122. Hatching in FIG. 6 indicates portions where attachment portion 21 contacts third protruding portion 14. In contact region T1, attachment portion 21 of powder cartridge 2 and convex portion 143 are in contact. W1 denotes a width of contact region T1 where a direction parallel to the x-y planar direction is defined as the widthwise direction. L1 denotes a distance from the center of convex portion 122 to contact region T1 in the widthwise direction. Here, L1 is the distance between convex portion 122 and contact region T1 in conformity with the form of a member of attachment portion 21. In contact region T2, attachment portion 21 and convex portion 144 are in contact. W2 denotes a width of contact region T2, which width is greater than that of contact region T1 (that is, W1<W2). L2 is a distance from the center of convex portion 122 to contact region T2 in the widthwise direction. L2 is greater than L1 (that is, L1<L2). Here, L2 is the distance between convex portion 122 and contact region T2 in conformity with the shape of a member of attachment portion 21. H1 is an amount of protrusion, namely a length of convex portion 143 of third protruding portion 14 in the z-axial direction (here, it is equal to the height of protruding end 141 in the z-axial direction). H2 is an amount of protrusion in the z-axial direction (here, it is equal to the height of protruding end 142). Thus, H1 is greater than H2. In other words, contact region T1 is greater than that of contact region T2 in the z-axial direction.

As for cushioning member 1, H1 of third protruding portion 14 is greater than H2 since L1 is smaller than L2, and W1 is smaller than W2. Due to a form of powder cartridge 2, cushioning member 1 is restricted to a form such that distance L1 from convex portion 122 to convex portion 143, and distance L2 from convex portion 122 to convex portion 144 differ from each other. Consequently, powder cartridge 2 is prone to be unstable in contact region T1 where a distance from convex portion 122 is shorter than that of contact region T2, in contrast to a case where distance L1 is the same as distance L2 (that is, L1=L2). In addition, increasing width W1 of contact region T1 in order to expand a contact area cannot readily be achieved, since cushioning member 1 is required to be of a form that fits a structure of powder cartridge 2 as described above. Further, as shown in FIGS. 4 and 5, cushioning member 1 has a form such that it can be fitted to powder cartridge 2 in either of two directions. Thus, provision of adequate dimensions for W1 necessarily is subject to constraint. In order to provide sufficient contact area in contact region T1, convex portion 143 of third protruding portion 14 protrudes further in the z-axial direction (that is the height of protruding end 141 in the z-axial direction), compared with contact region T2. Consequently, when powder cartridge 2 is detached in a direction away from base portion 11, a frictional force acting between convex portion 143 and attachment portion 21 becomes greater than a frictional force acting in a case where an amount of protrusion is relatively smaller. This frictional force is at least greater than that acting between convex portion 143 and attachment portion 21. By this structure, a sufficiently large contact region T1 can be provided with a result that powder cartridge 2 can be attached in a more stable state, although instability in the contact region may still likely to occur. It is to be noted that W2 of contact region T2 has a certain length. Accordingly, even if an amount of protrusion in the z-axial direction of convex portion 144 of third protruding portion 14 is relatively small, contact region T2 nonetheless a sufficiently large contact area, and powder cartridge 2 can therefore be fixed in a stable state.

In addition, when cushioning member 1 is fitted to powder cartridge 2 in accordance with the aspect shown in FIG. 5, distance L1 is shorter than distance L2. Thus, there is a possibility that powder cartridge 2 may become unstable for the reason as described above. However, second protruding portion 13 is formed such that an amount of protrusion H1 in the z-axial direction of convex portion 133 is greater than an amount of protrusion H2 of convex portion 134. Thus, convex portion 133 is also provided with a sufficiently large contact area relative to powder cartridge 2, with a result that powder cartridge 2 can be fixed in a stable state.

In A part shown in FIG. 2, protruding end 131 of second protruding portion 13 inclines from a side of convex portion 133 to a side of convex portion 134 in a direction towards base portion 11. Protruding end 141 of third protruding portion 14 inclines from a side of convex portion 143 to a side of convex portion 144 in a direction toward base portion 11. This form functions to guide powder cartridge 2 towards an appropriate fitted position, in that powder cartridge 2 is caused to move (rotate) along direction of the inclination; which holds true even in a cause where a powder cartridge 2 is not positioned properly in the circumferential direction. By this structure, powder cartridge 2 is guided to an appropriate fitting position under the influence of the inclined planes of protruding ends 131 and 141, with a result that a user can readily attach cushioning member 1 to powder cartridge 2. The inclined plane may be provided along the entirety of the protruding ends, or along only a part of the protruding ends.

As shown in FIG. 5, outer edge portion 15 has a pair of opposing faces, each of which has a curve. Packing box 3 is designed to store powder cartridge 2, and has an elongate shape with dimensions similar to those of powder cartridge 2. However, due to a thickness of a tab for sealing packing box 3, an aperture of packing box 3 is not exactly rectangular. The curves of cushioning member 1 provide margins for fitment with the shape of packing box 3. As a result of provision of these curves, cushioning member 1 can be readily and securely stored in packing box 3.

As described above, when the distances from convex portion 122 to convex portions 143 and 144, which are in contact with the outer circumferential surface of attachment portion 21 of powder cartridge 2, differ from each other, and the extent of contact in the widthwise direction of convex portion 143 is small, powder cartridge 2 is likely to be unstable at a position of convex portion 143. However, cushioning member 1 is formed such that an amount of protrusion in the z-axial direction of protruding portion 143 of third protruding portion 14 is greater than that of protruding portion 144. Thus, the contact area of convex portion 143 expands, and stability of powder cartridge 2 is enhanced. Accordingly, even where an available form of cushioning member 1 is limited, cushioning member 1 is still able to prevent powder cartridge 2 from becoming detached. Consequently, a user can remove powder cartridge 2 from packing box 3 without jamming of cushioning member 1 inside packing box 3. Packing box 3 may not have an enough space for cushioning member 1 and a hand of a user to be held at the same time. However, even in such a case, cushioning member 1 improves working efficiency, which may be worse by, for example, that the user takes a time to remove cushioning member 1 from packing box 3.

In addition, cushioning member 1 has a form such that it can be fitted to powder cartridge 2 in either one of two directions. Thus, a user can readily attach cushioning member 1 to powder cartridge 2. Further, inclined planes are provided at protruding ends 131 and 141, and powder cartridge 2 moves in a circumferential direction along the inclined planes, and is guided toward an appropriate position for fitting. Thus, a user can more readily attach cushioning member 1 to powder cartridge 2

Modification

The present invention can be practiced as a different exemplary embodiment from the foregoing exemplary embodiments. Also, modified examples described below may be combined with each other.

Modified Example 1

Figure 7:
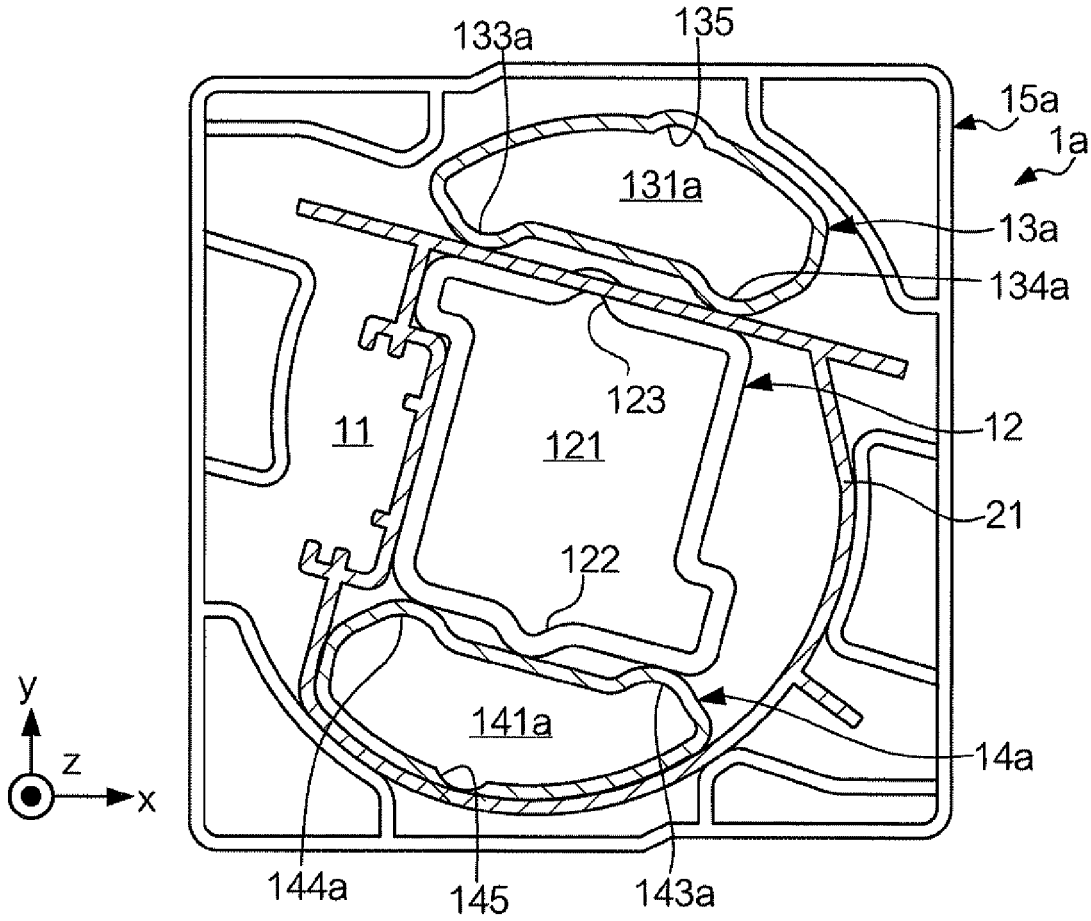
FIG. 7 is a top view of the cushioning member according to modified example 1 where the cushioning member is fitted to the powder cartridge.

Cushioning member 1 may be modified as cushioning member 1*a* shown in FIG. 7. FIG. 7 is a cross-sectional view of cushioning member 1*a* and the attachment portion taken along the same section line as shown in FIG. 3. It is to be noted that the like components to those present in cushioning member 1 are indicated by like reference numerals, and description of such components is omitted. Components corresponding to cushioning member 1 are indicated by like reference numerals to which suffix "a" is added.

Third protruding portion 14*a* of cushioning member 1*a* has convex portion 143*a* and convex portion 144*a*. A protruding amount in the z-axial direction of convex portion 143*a* is identical to a protruding amount in the z-axial direction of convex portion 144*a*. The protruding amount of convex end 141*a* is not great as that of convex end 141 of cushioning member 1. In this case, by increasing a frictional force between convex portion 143*a* and powder cartridge 2 that is applied when powder cartridge 2 is detached in a direction away from base portion 11, cushioning member 1*a* can also prevent powder cartridge 2 from becoming detached.

To increase the frictional force, convex portion 143*a* may protrude from a sidewall of third protruding portion 14*a* to the further outside, for example. In this case, a force of convex portion 143*a* acting on powder cartridge 2 becomes greater than that acting on convex portion 144*a*. Alternatively, a surface roughness of convex portion 143*a* may be increased to be greater than that of convex portion 144*a*. For example, a frictional force is caused to increase as result of formation of an asperity on the surface of convex portion 143*a* by use of sandpaper. Further, alternatively, a member for increasing surface drag such as a urethane foam seal may be provided on the surface of convex portion 143*a*. As described in the above exemplary embodiment, if convex portion 143 of third protruding portion 14*a* extends by a greater amount in the z-axial direction, a frictional force increases in the contact region, and cushioning member 1 prevents powder cartridge 2 from becoming detached. However, if there is a reason to prevent an amount of protrusion from increasing; or if an increase in the amount of protrusion is not implemented, it is still possible to attain the same effect as that attained in the exemplary embodiment, by increasing a frictional force of convex portion 143*a* as described. Further as shown in FIG. 7, cushioning member 1*a* has an identical form when rotated around the z-axis by 180 degrees, and cushioning member 1*a* is fitted to powder cartridge 2 in either one of two directions.

Modified Example 2

Figure 8:
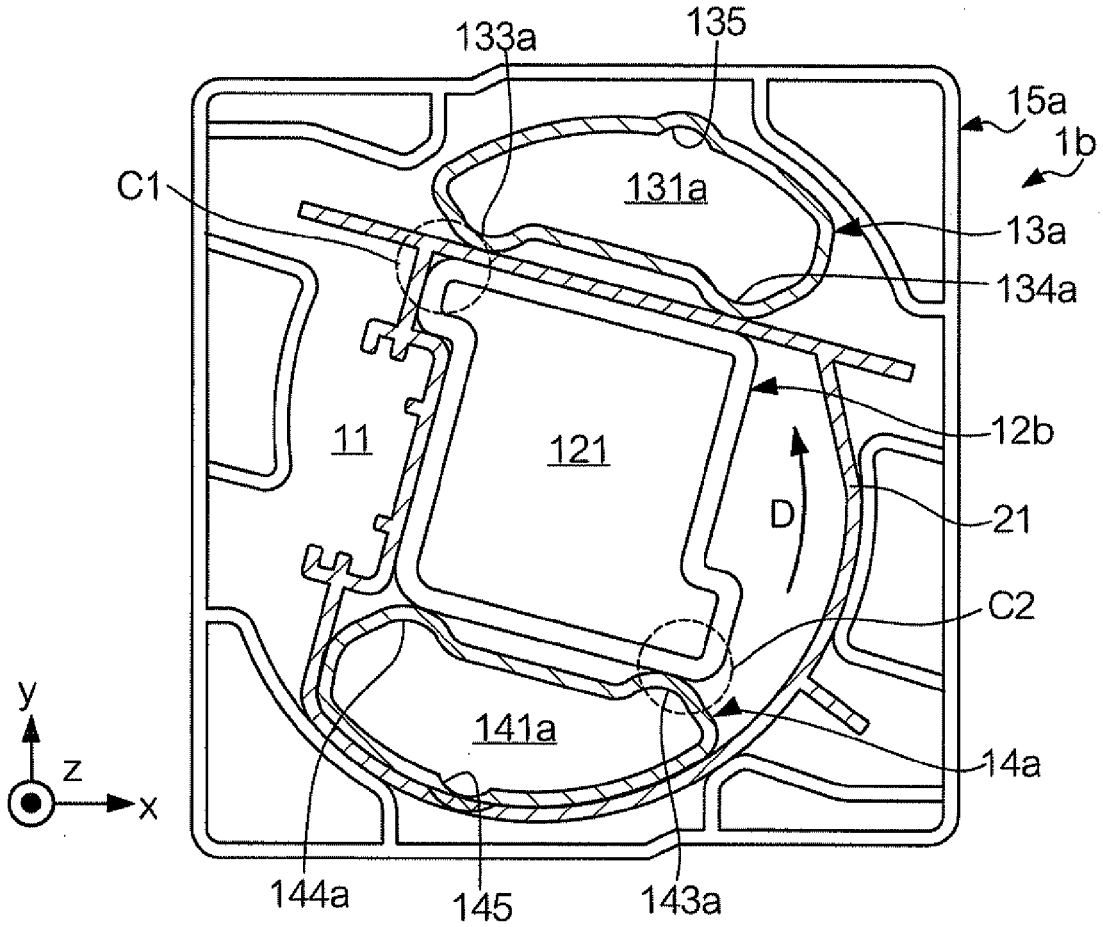
FIG. 8 is a top view of the cushioning member according to modified example 2 where the cushioning member is fitted to the powder cartridge.

Cushioning member 1*a* may be modified as cushioning member 1*b* shown in FIG. 8. FIG. 8 is a cross-sectional view of cushioning member 1*b* and the attachment portion taken along the same section line as shown in FIG. 3. It is to be noted that like components to those present in cushioning member 1*a* are indicated by the like reference numerals, and description of such components is omitted. Components corresponding to those in cushioning member 1*a* are indicated by reference numerals with suffix "b", instead of suffix "a."

Cushioning member 1*b* does not have convex portions 122 and 123 provided at first protruding portion 12 of cushioning member 1*a*. First protruding portion 12*b* has a sidewall that is generally flat. As shown in FIG. 8, the inner circumferential surface of attachment portion 21 contacts first protruding portion 12*b*, with corner portion C1 serving as the first portion. Corner portion C1 is a portion surrounding a corner in a sidewall of first protruding portion 12*b*. Corner portion C1 includes at least a part of a sidewall facing in a direction of second protruding portion 13*a*, and a part of a sidewall adjacent to this sidewall and facing in a direction different to that of second protruding portion 13*a*, among the sidewalls of first protruding portion 12*b*. A distance between corner portion C1 and convex portion 133*a* in cushioning member 1*b* is smaller than a distance between corner portion C1 and convex portion 134*a*. As for the distance from corner portion C1 to each of convex portions 133*a* and 134*a*, any position on surfaces included in corner portion C1 may be used as reference. For example, the reference position is a boundary portion of two adjacent sidewalls of corner portion C1.

When attachment portion 21 is detached in a direction away from base portion 11, a frictional force is applied to convex portions 133*a* and 134*a* of cushioning member 1*b*. The frictional force applied to convex portion 134*a* is greater than the frictional force applied to convex portion 133*a*. It is to be noted that a cause of a variation of frictional forces is the same as described in modified example 1. Corner portion C1 prevents a rotation in the circumference direction (a direction indicated by arrow D in FIG. 8) of attachment portion 21 of powder cartridge 2. Corner portion C1 may be the center of this rotation. A distance from corner portion C1 to convex portion 134*a* is greater than a distance from corner portion C1 to convex portion 133*a*. By increasing the frictional force of convex portion 134*a* to be greater than the frictional force of convex portion 133*a*, the following effect is attained, as compared with a case where a relation between the frictional forces is opposing, or in a case where each of the frictional forces is present at a high level. A force acting on powder cartridge 2 in the circumferential direction exerts a strong influence on convex portion 134*a*. According to the structure of cushioning member 1*b*, a rotation of powder cartridge 2 can more effectively be prevented at convex portion 134*a*, and a user accordingly readily attaches cushioning member 1*b* to powder cartridge 2 and detach cushioning member 1*b* from powder cartridge 2.

Further, cushioning member 1*b* has an identical form when rotated around z-axis by 180 degrees. In this case, the inner circumferential surface of attachment portion 21 contacts first protruding portion 12*b* with corner portion C2 serving as a fourth contact region. Corner portion C2 is a portion surrounding a corner in a sidewall of first protruding portion 12*b*. Corner portion C2 includes at least a part of a sidewall facing in a direction of third protruding portion 14*a*, and a part of a sidewall adjacent to this sidewall and facing in a different direction from third protruding portion 14*a*, among the sidewalls of first protruding portion 12*b*. A distance between corner portion C2 and convex portion 143*a* in cushioning member 1*b* is smaller than a distance between corner portion C2 and convex portion 144*a*. As for the distance from corner portion C2 to each of convex portions 143*a* and 144*a*, any position on surfaces included in corner portion C2 may be used as reference. For example, the reference position is a boundary portion of two adjacent sidewalls of corner portion C2. When attachment portion 21 is detached in a direction away from base portion 11, a frictional force occurs in convex portions 143*a* and 144*a*. In this aspect, by increasing the frictional force of convex portion 144*a* than the frictional force of convex portion 143*a*, it is still possible to attain the same effect as that attained in the exemplary embodiment.

Modified Example 3

In the above exemplary embodiment, the protruding end need not necessarily be inclined. The form of outer edge portion 15 is one example only, and the outer edge may be constituted to have a different shape and/or dimensions. Further, cushioning member 1 need not necessarily be provided with outer edge portion 15.

In the above exemplary embodiment, it is described that a cause of a lack of stability in contact region T1 is that a structure of cushioning member 1 is such that it allows fitting to powder cartridge 2 in either on of two directions. In a case that cushioning member 1 does not have a structure that allows fitting in either of two directions, it is possible that a shape and dimensions of the protruding portion of cushioning member 1 may be restricted due to a form of powder cartridge 2 or other reason. In such a case, by taking the structure described in the above exemplary embodiment or in the modified example, powder cartridge 2 can nonetheless be fitted to be in a stable state by use of the cushioning member, as described in the exemplary embodiment of the present invention.

Modified Example 4

In the above exemplary embodiment, W1 is smaller than W2. However, in a case that W1 is equal to W2, powder cartridge 2 will be unstable if L1 is smaller than L2. To compensate, H1 can be increased to be greater than H2, thereby attaining the same effect as that attained in the exemplary embodiment. If W1 is greater than W2 or L1 is greater than L2, H2 can be made greater than H1. It is to be noted that a form of the protruding portion is not limited to a form having a height each overall that is equivalent to H1, H2. Indeed the only requirement is that the protruding portion has such a height relationship at least at a position where it is in contact with the attachment portion of powder cartridge 2 (for example, contact regions T1, T2).

Modified Example 5

In the above exemplary embodiment, L1 is not equal to L2. However, L1 may be equal to L2. In this case, a problem of lack of stability due to a variation in the distance from convex portion 122 to each of convex portions 143, 144 will not arise. However, in a case that W1 is smaller than W2, an extent of contact in the widthwise direction of convex portion 143 (contact region T2) will become small, and the powder cartridge 2 will accordingly lack stability. In this case, by forming third protruding portion 14 or second protruding portion 13 such that H1 is greater than H2, thereby attaining the same effect as that attained in the exemplary embodiment. In the above exemplary embodiment, a distance from the convex portion to each of the contact regions in relation to a shape of a member of attachment portion 21 is employed for a distance between convex portion 122 and convex portions 143, 144, and for a distance between convex portion 123 and convex portions 133, 134. However, a shortest distance to the contact region in the x-y planar direction (that is a distance in a straight line), or a distance to the center of the contact region, or a distance to the centroid of the contact region (which may be a distance along the member of attachment part 21, or a distance in a straight line) may be employed. In this regard, a variety of embodiments can be envisaged for employment in configuring a distance and a reference position relative to the contact region.

An object to be fitted by cushioning member 1 is not limited to powder cartridge 2. Indeed the only requirement is that the object has a tubular part at its end, and that a cushioning member is fitted to the tubular part. The product to be protected by cushioning member 1 according to the exemplary embodiment of the present invention is not limited to powder cartridge 2.

The number of contact parts between powder cartridge 2 according to the exemplary embodiment and each of first protruding portion 12, second protruding portion 13, and third protruding portion 14 are provided by way of example, only. For example, the number of contact parts may be increased. Cushioning member 1 may be formed by integral molding of parts, or by a combination of a plurality of different parts.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cushioning member for holding a tubular part in a first contact region, a second contact region and a third contact region, the tubular part having an inner circumferential surface, the cushioning member comprising:

a base portion;

a first protruding portion that protrudes from the base portion, the first protruding portion having a first sidewall and a first portion protruding from the first sidewall of the first protruding portion;

a second protruding portion that protrudes from the base portion, the second protruding portion having a second sidewall and a part protruding from the second sidewall of the second protruding portion; and a third protruding portion that protrudes from the base portion, the third protruding portion having a third sidewall, a second portion and a third portion protruding from the third sidewall of the third protruding portion, wherein:

the first protruding portion is located between the second protruding portion and the third protruding portion, the cushioning member is configured to fit the tubular part in a first facing direction such that an inner circumferential surface of the tubular part contacts the part of the second protruding portion, the first portion contacts the first contact region, the second portion contacts the second contact region, and the third portion contacts the third contact region, the first contact region being located between the second contact region and the third contact region as viewed in a direction normal to the first contact region, and a distance between the first contact region and the second contact region is smaller than a distance between the first contact region and the third contact region, and a length of the second contact region from the base portion in a direction of protrusion is greater than a length of the third contact region from the base portion in a direction of protrusion.

2. The cushioning member according to claim 1, wherein:

the first protruding portion further includes a fourth sidewall and a fourth portion protruding from the fourth sidewall of the first protruding portion, the second protruding portion further includes a fifth sidewall, a fifth portion and a sixth portion, the fifth portion and sixth portion each protruding from the fifth sidewall of the second protruding portion, the third protruding portion includes a sixth sidewall and a part protruding from the sixth sidewall of the third protruding portion, the cushioning member is configured to fit the tubular part in a second facing direction such that the inner circumferential surface contacts the part of the third protruding portion, the cushion member further including a fourth contact region, a fifth contact region and a sixth contact region, the fourth portion configured to contact the fourth contact region, the fifth portion configured to contact the fifth contact region, and the sixth portion configured to contact the sixth contact region, the fourth contact region is located between the fifth contact region and the sixth contact region as viewed in a direction normal to the fourth contact region, and a distance between the fourth contact region and the fifth contact region is smaller than a distance between the fourth contact region and the sixth contact region, and a length of the fifth contact region from the base portion in the direction of protrusion is greater than a length of the sixth contact region from the base portion in the direction of protrusion.

3. The cushioning member according to claim 1, wherein the tubular part is a powder container.

4. A cushioning member for holding a tubular part in a first contact region, a second contact region and a third contact region, the tubular part having an inner circumferential surface, the cushioning member comprising:

a base portion;

a first protruding portion that protrudes from the base portion, the first protruding portion having a first sidewall and a first portion protruding from the first sidewall of the first protruding portion;

a second protruding portion that protrudes from the base portion, the second protruding portion having a second sidewall and a part protruding from the second sidewall of the second protruding portion; and a third protruding portion that protrudes from the base portion, the third protruding portion having a third sidewall, a second portion and a third portion protruding from the third sidewall of the third protruding portion, wherein:

the first protruding portion is located between the second protruding portion and the third protruding portion, the cushioning member is configured to fit the tubular part in a first facing direction such that an inner circumferential surface of the tubular part contacts the part of the second protruding portion, the first portion contacts the first contact region, the second portion contacts the second contact region, and the third portion contacts the third contact region, the first contact region being located between the second contact region and the third contact region as viewed in a direction normal to the first contact region, and a distance between the first contact region and the second contact region is smaller than a distance between the first contact region and the third contact region, and a frictional force in the second contact region, which occurs when the tubular part is detached in a direction away from the base portion, is greater than a frictional force in the third contact region.

5. The cushioning member according to claim 4, wherein:

the first protruding portion further includes a fourth sidewall and a fourth portion protruding from the fourth sidewall of the first protruding portion, the second protruding portion further includes a fifth sidewall, a fifth portion and a sixth portion, the fifth portion and the sixth portion each protruding from the fifth sidewall of the second protruding portion, the third protruding portion further includes a sixth sidewall and a part protruding from the sixth sidewall of the third protruding portion, the cushioning member is configured to fit the tubular part in a second facing direction such that the inner circumferential surface contacts the part of the third protruding portion, the cushion member further including a fourth contact region, a fifth contact region and a sixth contact region, the fourth portion configured to contact the fourth contact region, the fifth portion configured to contact the fifth contact region, and the sixth portion configured to contact the sixth contact region, the fourth contact region is located between the fifth contact region and the sixth contact region as viewed in a direction normal to the fourth contact region, and a distance between the fourth contact region and the fifth contact region is smaller than a distance between the fourth contact region and the sixth contact region, and a frictional force in the fifth contact region, which occurs when the tubular part is detached in a direction away from the base portion, is greater than a frictional force in the sixth contact region.

6. The cushioning member according to claim 4, wherein the tubular part is a powder container.

7. The cushioning member according to claim 2, wherein:

the second protruding portion further includes, at a protruding end, a surface inclined from a side of the fifth portion to a side of the sixth portion in a direction toward the base portion, and the third protruding portion further includes, at a protruding end, a surface inclined from a side of the second portion to a side of the third portion in a direction toward the base portion.

8. The cushioning member according to claim 5, wherein:

the second protruding portion further includes, at a protruding end, a surface inclined from a side of the fifth portion to a side of the sixth portion in a direction toward the base portion; and the third protruding portion further includes, at a protruding end, a surface inclined from a side of the second portion to a side of the third portion in a direction toward the base portion.

9. A cushioning member for holding a tubular part in a first contact region, a second contact region and a third contact region, the tubular part having an inner circumferential surface, the cushioning member comprising:

a base portion;

a first protruding portion that protrudes from the base portion, the first protruding portion having a first sidewall and a first portion that is a corner in the first sidewall of the first protruding portion;

a second protruding portion that protrudes from the base portion, the second protruding portion having a second sidewall and a part protruding from the second sidewall of the second protruding portion; and a third protruding portion that protrudes from the base portion, the third protruding portion having a third sidewall, a second portion and a third portion protruding from the third sidewall of the third protruding portion, wherein:

the first protruding portion is located between the second protruding portion and the third protruding portion, the cushioning member is configured to fit the tubular part in a first facing direction such that an inner circumferential surface of the tubular part contacts the part of the second protruding portion, the first portion contacts the first contact region, the second portion contacts the second contact region, and the third portion contacts the third contact region, and a distance between the first contact region and the second contact region is smaller than a distance between the first contact region and the third contact region, and a frictional force in the third contact region, which occurs when the tubular part detached in a direction away from the base portion, is greater than a frictional force in the second contact region.

10. The cushioning member according to claim 9, wherein:

the first protruding portion further includes a fourth sidewall and a fourth portion that is a corner in the fourth sidewall of the first protruding portion;

the second protruding portion further includes a fifth sidewall, a fifth portion and a sixth portion, the fifth portion and the sixth portion each protruding from the fifth sidewall of the second protruding portion;

the third protruding portion further includes a sixth sidewall and a part protruding from the sixth sidewall of the third protruding portion;

the cushioning member is configured to fit the tubular part in a second facing direction such that the inner circumferential surface contacts the part of the third protruding portion, the cushion member further including a fourth contact region, a fifth contact region and a sixth contact region, the fourth portion configured to contact the fourth contact region, the fifth portion configured to contact the fifth contact region, and the sixth portion configured to contact the sixth contact region, and a distance between the fourth contact region and the fifth contact region is smaller than a distance between the fourth contact region and the sixth contact region, and a frictional force in the sixth contact region, which occurs when the tubular part is detached in a direction away from the base portion, is greater than a frictional force in the fifth contact region.

11. The cushioning member according to claim 9, wherein the tubular part is a powder container.

* * * * *